US008663744B2

(12) United States Patent
Willemsen et al.

(10) Patent No.: US 8,663,744 B2
(45) Date of Patent: Mar. 4, 2014

(54) METHOD FOR IMPROVING ARAMID YARN BUNDLE COHESIVENESS

(75) Inventors: Stephanus Willemsen, Rheden (NL); Martinus Peters, Nijmegen (NL); Johannes Janssen, Heijen (NL)

(73) Assignee: Teijin Aramid B.V., Arnhem (NL)

( * ) Notice: Subject to any disclaimer, the term of this patent is extended or adjusted under 35 U.S.C. 154(b) by 646 days.

(21) Appl. No.: 11/664,581

(22) PCT Filed: Nov. 26, 2005

(86) PCT No.: PCT/EP2005/012664

§ 371 (c)(1), (2), (4) Date: Apr. 4, 2007

(87) PCT Pub. No.: WO2006/058676

PCT Pub. Date: Jun. 8, 2006

(65) Prior Publication Data

US 2008/0090041 A1 Apr. 17, 2008

(30) Foreign Application Priority Data

Dec. 1, 2004 (EP) ..... 04028395

(51) Int. Cl.

| | |
|---|---|
| ***B05D 1/36*** | (2006.01) |
| ***B05D 7/00*** | (2006.01) |
| *B29D 22/00* | (2006.01) |
| *B29D 23/00* | (2006.01) |
| *B32B 1/08* | (2006.01) |

(52) U.S. Cl.
USPC ..... 427/412; 427/402; 428/36.1

(58) Field of Classification Search
USPC ..... 428/36.1; 156/148, 296; 427/412, 402
See application file for complete search history.

(56) References Cited

U.S. PATENT DOCUMENTS

| | | | | |
|---|---|---|---|---|
| 4,455,341 | A * | 6/1984 | Harteman | 442/188 |
| 5,107,069 | A | 4/1992 | Wichelhaus et al. | |
| 5,139,873 | A * | 8/1992 | Rebouillat | 428/375 |
| 5,674,615 | A | 10/1997 | Neuert et al. | |

FOREIGN PATENT DOCUMENTS

| | | |
|---|---|---|
| EP | 0 358 023 A2 | 3/1990 |
| EP | 0 416 486 A2 | 3/1991 |
| JP | A 09-041274 | 2/1997 |
| JP | A 10-158939 | 6/1998 |
| WO | WO 03066943 A1 * | 8/2003 |

* cited by examiner

*Primary Examiner* — Michael Cleveland
*Assistant Examiner* — James M Mellott
(74) *Attorney, Agent, or Firm* — Oliff PLC

(57) ABSTRACT

A method improves bundle cohesiveness of a bundle of aramid yarns, and decreasing its friction coefficient. The method includes adding to the bundle of yarns 0.1-3.0 wt. %, based on the yarn weight, of a water-soluble or water-dispersible film forming binding agent, followed by treating the bundle of yarns with an oil having an intrinsic viscosity less than 100 $mm^2/s$.

12 Claims, 1 Drawing Sheet

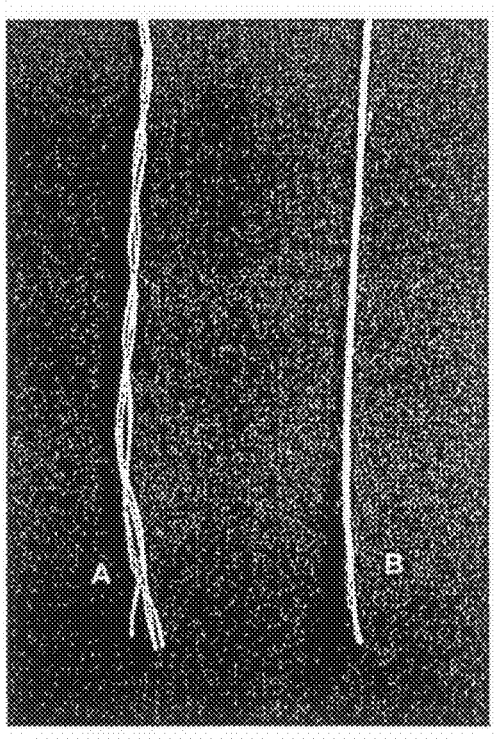
A
B

METHOD FOR IMPROVING ARAMID YARN BUNDLE COHESIVENESS

BACKGROUND OF THE INVENTION

1. Field of Invention

The invention relates to a method for improving bundle cohesiveness of a bundle of aramid yarn, to a method for knitting, sewing, or braiding said bundles of aramid yarn, and to knitted tubes comprising said bundles for automotive applications.

2. Description of Related Art

Aramid cords of spun yarns or stretch broken yarns are frequently used as reinforcing materials in rubber, thermoplastic materials or thermosets. The aramid cord consists of two or more twisted spun yarns or stretch broken yarns which are plied into a cord. The cord is used as such or after being processed on suitable equipment as a knitting, a braiding or a fabric. The processing of such aramid cords on machines, however, is problematic and often leads to breakages or repeated stops of the knitting, braiding, sewing machine, or weaving loom, which is used. Furthermore, during processing such aramid cords easily lose filaments and polymer parts easily fall out of the individual yarns and form deposits on and in machine parts. Particularly, the blocking of needles used for knitting or sewing leads to irregularities in the final form of the reinforcement. As a result of these irregularities the cord reinforcement fails in the matrix and the lifetime of the reinforcing material is reduced drastically.

Bundles of aramid fiber have been treated with various components. For instance, in JP 10-158939, a bundle of multifilament yarn, including aramid fibers, is treated with an oil to prevent fluffing during finishing processes. In JP 09-041274, a bundle of aramid fibers is treated with a water-soluble polyester to improve bundling power, but the materials are used for completely different application, i.e., reinforcing materials for cement materials.

When bundles of aramid yarn are used for knitting, braiding, and sewing, the known bundles have the above-mentioned disadvantages. Suitable aramid yarns (fibers) are not known for such purpose. The term "bundle of aramid yarn" includes a bundle of at least two individual yarns, particularly cords made of aramid yarns.

In U.S. Pat. No. 4,455,341, a multifilament yarn of an aromatic polyamide, in particular poly-p-phenylene terephthalamide, was provided with a water-soluble size. In addition to the size, the yarn may be provided with a non-ionic wax. The sized yarn is used as warp and weft yarn in the weaving industry. It was now found (see example 3) that the friction of the non-ionic wax treated yarn is still too high to make these yarns optimally suitable for use in cord knitting machines. Therefore, there is still a need in obtaining yarns with a low coefficient of friction and, at the same time, having good bundle cohesiveness.

SUMMARY

Therefore, an object herein is to provide a bundle of aramid yarns, having excellent bundle cohesiveness and, at the same time, a low friction coefficient to allow easy knitting, braiding, and sewing.

BRIEF DESCRIPTION OF DRAWING

FIG. 1 is a photograph illustrating an untreated cord shown in comparison with a treated cord in an embodiment of the present disclosure.

EMBODIMENTS

The present invention relates to a method for improving bundle cohesiveness of a bundle of aramid yarn and decreasing its friction coefficient, comprising adding to the bundle of yarns 0.1-3.0 wt. %, based on the yarn weight, of a water-soluble or water-dispersible film forming binding agent, followed by treating the bundle of yarns with an oil having an intrinsic viscosity less than 100 $mm^2/s$ (at 25° C.).

Bundles of aramid yarns, such as cords, according to the invention, are treated with a film forming binding agent and an overlay finish. The binding agent improves the interfilament and yarn cohesion, and should be a film-forming polymer. Preferably, the binding agent is a water-soluble or water-dispersible polyurethane and/or sulfonated polyester resin. Examples of suitable polyesters are polymers derived from a sulfonated dicarboxylic acid, a dicarboxylic acid and a diol. Preferred is polyester derived from dimethyl sodium sulfoisophthalic acid, isophthalic acid and ethylene glycol. Such a product is available under the trade name Eastman® LB-100. Examples of suitable polyurethanes are polyether-polyurethane or polyester-polyurethane dispersions, available under the trade names Alberdingk® U400N and Impranil® DLF, respectively. The overlay finish is an oil with low intrinsic viscosity, which reduces the yarn to metal friction of the cord. Preferably, the overlay finish is an ester oil. These cord characteristics result in failure-free knitting, sewing, or braiding behavior. Examples of suitable oils are 2-ethyl hexyl stearate, 2-ethyl hexyl palmitate, n-butyl laurate, n-octyl caprilate, butyl stearate or mixtures thereof. A preferred ester oil is a mixture of 2-ethyl hexyl stearate and 2-ethyl hexyl palmitate, which is available under the trade name LW® 245.

The use of the above sizing, as such, is known from U.S. Pat. No. 4,455,341 (hereinafter "US '341"). However, US '341 relates to sizing of individual fibers for improving the cohesiveness of the filaments in the fiber, rather than applying the sizing to a bundle of yarns to improve the cohesiveness of the individual yarns rather than the filaments. Moreover, US '341 requires the use of a non-ionic wax, which use would be detrimental when using the bundle of yarns in a knitting device.

The bundle of yarns that can be treated according to the present method may be any aramid yarn, including spun yarn and stretch broken yarn. Stretch broken (also known as spunnized yarn) is particularly suitable for use in the instant method. Suitable aramids include the meta-aramid and para-aramid yarns, such as Teijinconex® yarns [poly-(meta-phenylene isophthalamide); MPIA], Twaron® yarns [poly(paraphenyleneterephthalamide); PPTA] and Technora® yarns [co-poly-(paraphenylene/3,4'-oxydiphenylene terephthalamide)].

Finally, another objective is to provide a method for knitting, sewing, or braiding bundles of aramid yarn comprising the use of a bundle of yarns to which has been added 0.1-3.0 wt. %, based on the yarn weight, of a water-soluble or water-dispersible film forming binding agent, and thereafter an oil having an intrinsic viscosity less than 100 $mm^2/s$.

The yarns that are treated according to the method of the present invention show strong cohesion properties, i.e., the cord containing these yarns has a low tendency to split into individual yarns. Further, the bundle (cord) is shown to have improved friction properties. Therefore, the bundles of yarns of the present invention are suitable for use in methods for knitting, sewing, or braiding, and for making knitted tubes for use in automotive applications.

The present invention is further explained and the advantages are shown in the following non-restrictive illustrative examples.

Determination of the (Yarn-to-Metal) Friction Coefficient (f)

For the determination of the friction coefficient of the cord, the cord was guided from the bobbin over a magnetic tension device. Then, the cord passed a tension measuring head (pretension T1), a friction pin (angle of wrap 90°), a second tension measuring head (aftertension T2) and a godet. Finally, the cord was wound. During the determination, the aftertension (T2) was measured. The friction coefficient was calculated under the conditions as follows:

| | |
|---|---|
| Conditions climate room: | 20° C./65% RH |
| Cord/godet speed: | 50 m/min |
| Pretension (T1): | 50 cN fixed by means of a magnetic tension device |
| Friction pin: | smooth chromium plated steel |
| Friction pin diameter: | 32 mm |
| Calculation friction coefficient (f): | $f = 1/\alpha * 1n (T2/T1)$ |

wherein $\alpha$ = angle of wrap in radians ($\frac{1}{2}\pi$)

conex® KB stretch broken yarn (1100 dtex×3Z80) and was subjected to the following treatments.

A cord package was rollingly unwound while successively passing the cord over a liquid applicator A, through a steam box (temperature 240° C., residence time 10 seconds), passing the cord over a liquid applicator B and finally wound into a package at a speed of 60 m/min. With the liquid applicator A and a tubing pump, the cord was treated with an aqueous binding agent mentioned in Table I. With the liquid applicator B and a syringe pump, the cord was treated with the overlay finish (neat oil) mentioned in Table II. The following process conditions were varied:

a) the composition of the binding agent;

b) the dosed amount of the binding agent; and c) the dosed amount of the overlay finish.

The produced cords were tested on their yarn-to-metal friction and bundle cohesiveness according to the cutting test. Furthermore, the mechanical characteristics and the moisture content of some cords were determined. As a reference, untreated cord of Teijinconex® KB was tested. The results are shown in Table III.

Cords of experiment 2B and 1E showed an excellent knitting behavior on a Lucas circular knitting machine, while untreated cord (experiment 4) showed a bad knitting performance (stops and failures) on the same machine.

TABLE I

Aqueous polyester and polyurethane based binding agents

| Resin composition code | a1 | a2 | a3 | b1 | b2 | b3 | c1 | c2 | c3 |
|---|---|---|---|---|---|---|---|---|---|
| Resin concentration in wt. % | 1.0 | 2.0 | 3.0 | 1.0 | 2.0 | 3.0 | 1.0 | 2.0 | 3.0 |
| Eastman LB-100 (100%) | 1.0 | 2.0 | 3.0 | | | | | | |
| Alberdingk U 400N (40%) | | | | 2.5 | 5.0 | 7.5 | | | |
| Impranil ® DLF (40%) | | | | | | | 2.5 | 5.0 | 7.5 |
| Demineralized water | 99.0 | 98.0 | 97.0 | 97.5 | 95.0 | 92.5 | 97.5 | 95.0 | 92.5 |

The Cutting Test

A cord sample of 100 cm long is vertically suspended over a table. A top end of the cord is secured in a clamp. To the free, lower end of the sample, there is attached such a weight that the tension in the cord is 0.15 cN/dtex. Rotation of the free hanging cord should be prevented. Subsequently, the cord is cut with a pair of scissors at 75 cm below the point of suspension. Next, of the remaining suspended three fourths of the cord sample, the length is measured of the flared newly formed end at the point where the cord was cut through. The extent to which the cord has opened longitudinally, as a result of its having been cut through under the above-mentioned tension, is indicative of the degree of cohesion of the yarns. The test is carried out in five-fold and the average value (cm) is the cutting test value. The test is indicative for the adhesiveness of the individual yarns in the bundle of yarns.

Example 1

Experiments 1A-1J, 2A-2J, 3A-3J, 4

This example illustrates the application of a binding agent in combination with an overlay finish on a 3-ply cord of Teijinconex® KB. The cord was produced out of Teijin- Eastman LB-100 is a water-dispersable polyester polymer, supplier Eastman Chemical Company, Kingsport, USA. Alberdingk U 400N (40%) is a polyether-polyurethane dispersion in water, supplier Alberdingk Boley GmbH, Krefeld, Germany. Impranil® DLF (40%) is a polyester-polyurethane dispersion in water, supplier Bayer AG, Leverkusen, Germany.

TABLE II

Overlay finish

| Code overlay finish | d |
|---|---|
| Concentration in wt. % | 100 |
| LW 245 | 100 |

LW 245 is a low viscous esteroil (mixture of 2-ethyl hexyl stearate and 2-ethyl palmitate) with a viscosity of 14.6 $mm^2$/sec (25° C.), supplier Cognis, Dësseldorf, Germany.

TABLE III

Results of example 1

| Exp. No. | Binding agent amount on yam % | Binding agent code | Overlay finish Tret N81 | Moisture content % | Strength N | Linear density dtex | Elong. % | Coefficent of friction f | Cutting test value cm |
|---|---|---|---|---|---|---|---|---|---|
| 1A* | 0.3 | a1 | none | 4.1 | | | | 0.50 | 7.7 |
| 1B | 0.3 | a1 | 0.30% | 3.9 | 131 | 3563 | 12.1 | 0.38 | 6.5 |
| 1C | 0.3 | a1 | 0.50% | 4.0 | | | | 0.38 | 9.2 |
| 1D* | 0.6 | a2 | none | 3.7 | | | | 0.51 | 2.2 |
| $1^E$ | 0.6 | a2 | 0.30% | | 139 | 3556 | 12.2 | 0.39 | 1.9 |
| 1F | 0.6 | a2 | 0.50% | | | | | 0.39 | 1.9 |
| 1G* | 0.9 | a3 | none | 3.7 | | | | 0.52 | 1.6 |
| 1H | 0.9 | a3 | 0.30% | | 133 | 3632 | 12.1 | 0.37 | 1.2 |
| 1J | 0.9 | a3 | 0.50% | | | | | 0.36 | 1.4 |
| 2A* | 0.3 | b1 | none | 4.6 | | | | 0.50 | 4.4 |
| 2B | 0.3 | b1 | 0.30% | | 135 | 3486 | 12.3 | 0.44 | 6.1 |
| 2C | 0.3 | b1 | 0.50% | | | | | 0.43 | 5.8 |
| 2D* | 0.6 | b2 | none | 4.1 | | | | 0.50 | 1.7 |
| $2^E$ | 0.6 | b2 | 0.30% | | 130 | 3526 | 12.0 | 0.43 | 2.4 |
| 2F | 0.6 | b2 | 0.50% | | | | | 0.43 | 1.7 |
| 2G* | 0.9 | b3 | none | 3.9 | | | | 0.52 | 1.2 |
| 2H | 0.9 | b3 | 0.30% | | 129 | 3641 | 11.3 | 0.46 | 1.4 |
| 2J | 0.9 | b3 | 0.50% | | | | | 0.45 | 1.1 |
| 3A* | 0.3 | c1 | none | 3.9 | | | | 0.50 | 4.1 |
| 3B | 0.3 | c1 | 0.30% | | 133 | 3570 | 11.4 | 0.43 | 6.5 |
| 3C | 0.3 | c1 | 0.50% | | | | | 0.42 | 5.3 |
| 3D* | 0.6 | c2 | none | 3.8 | | | | 0.49 | 2.4 |
| 3E | 0.6 | c2 | 0.30% | | 122 | 3527 | 10.3 | 0.43 | 1.8 |
| 3F | 0.6 | c2 | 0.50% | | | | | 0.42 | 2.7 |
| 3G* | 0.9 | c3 | none | 3.7 | | | | 0.49 | 1.4 |
| 3H | 0.9 | c3 | 0.30% | | 141 | 3537 | 11.9 | 0.43 | 1.2 |
| 3J | 0.9 | c3 | 0.50% | | | | | 0.41 | 1.5 |
| 4* | Untreated Teijin Conex KB cord | | | 4.0 | 135 | 3478 | 11.9 | 0.52 | 28.4 |

*comparison examples

Example 2

Experiments 5, 6

A cord was produced out of Teijinconex® KB stretch broken yarn (1100 dtex×2Z120) and was subjected to the same treatment as described for experiment 1E and set forth above. As a reference, untreated cord of Teijinconex® KB was tested. The results are shown in Table IV. The cord treated according to the invention showed excellent bundle cohesion and a low friction coefficient.

TABLE IV

Results of experiments 5 and 6

| Exp. No. | Binding agent amount on yam % | Binding agent code | Overlay finish Tret N81 | Moisture content % | Strength N | Linear density dtex | Elong. % | Coefficent of friction f | Cutting test value cm |
|---|---|---|---|---|---|---|---|---|---|
| 5 | 0.6 | a2 | 0.30% | 1.8 | 97 | 2352 | 12.1 | 0.35 | 0.6 |
| 6* | Untreated Teijinconex ® KB cord | | | 3.7 | 96 | 2270 | 12.2 | 0.44 | 12.1 |

*comparison example

FIG. 1 is a photograph showing the effect of the method of the invention. In FIG. 1, an untreated (A) cord (3×1100 dtex) is shown in comparison with a cord (B) treated according to the invention, after the cutting test.

Example 3

In this example, the effect of an oil having an intrinsic viscosity less than 100 $mm^2/s$ at 25° C. in comparison with a non-ionic wax is shown. A cord was produced out of Teijinconex™ KB stretch broken yarn (1100 dtex×3Z80). This cord was subjected to the following treatments. The cord package was rollingly unwound while successively passing the cord over a liquid applicator A, through a hot air oven (temperature 240° C., residence time 10 seconds), passing the cord over a liquid applicator B (in case of oil) or a heated metal kiss roll C (in case of wax) and finally wound into a package at a speed of 36 m/min. With the liquid applicator A and a tubing pump, the cord was treated with 0.6 wt. % of the binding agent Eastman LB 100 (water-dispersable polyester polymer, supplier Eastman Chemical Company, Kingsport, USA) from a 2.0 wt. % aqueous solution. The cord was treated with oil LW 245 (viscosity of 14.6 $mm^2/s$ at 25° C.) using liquid applicator B and a syringe pump. In the comparison, the cord was treated with the molten wax Bevaloid® 356 using the heated kiss roll C. Bevaloid® 356 is a non-ionic wax (supplier Kemira Chimie SA, Lauterbourg, France) and is recommended by Kemira as replacement for the non-ionic wax Sopromine®

CF, which is no longer available. The coefficient of friction (yarn-to-metal) of the treated cords was determined as set forth above.

The results are shown in Table V below.

TABLE V

Coefficient of friction of treated Teijinconex ® KB cords

| Binding agent Eastman LB 100 on cord (wt. %) [1] | Overlay finish [1] LW 245 (oil) on cord (wt. %) | Overlay finish [1] Bevaloid ® 356 (non-ionic wax) on cord (wt. %) [2] | Coefficient of friction f |
|---|---|---|---|
| 0.6* | none | none | 0.36 |
| 0.6 | 0.5 | | 0.24 |
| 0.6 | 1.0 | | 0.24 |
| 0.6* | | 0.5 | 0.28 |
| 0.6* | | 1.0 | 0.31 |

[1] dosed amount

[2] to apply the correct amount of wax, first a calibration curve (wax uptake versus kiss roll speed) was made.

*reference examples

The lowest yarn-to-metal friction of Teijinconex® KB cord is achieved when an oil (viscosity<100 $mm^2/s$ at 25° C.) is used as an overlay finish. The use of a non-ionic wax as overlay finish is less effective and will therefore lead to earlier process stops and breakages on, for example cord knitting machines.

The invention claimed is:

1. A method for improving cord cohesiveness of a cord comprising two or more aramid yarns and decreasing its friction coefficient, the method comprising adding to the cord of aramid yarn 0.1 wt. % to 3.0 wt. %, based on the cord weight, of a water-soluble or water-dispersible film forming binding agent, followed by treating the cord of yarn with an overlay finish consisting of an oil having an intrinsic viscosity less than 100 $mm^2/s$ at 25° C.

2. The method according to claim 1 wherein the film forming binding agent is water-dispersible polyurethane or sulfonated polyester, or a mixture thereof.

3. The method according to claim 2, wherein the aramid yarns are stretch broken yarn.

4. The method according to claim 2, wherein the aramid yarns are poly-(meta-phenylene isophthalamide) yarn.

5. The method according to claim 1, wherein the aramid yarns are stretch broken yarn.

6. The method according to claim 5, wherein the aramid yarns are poly-(meta-phenylene isophthalamide) yarn.

7. The method according to claim 1, wherein the aramid yarns are poly-(meta-phenylene isophthalamide) yarn.

8. The method according to claim 1, wherein the oil is an ester oil.

9. The method according to claim 1, wherein the oil is selected from the group consisting of 2-ethyl hexyl stearate, 2-ethyl hexyl palmitate, n-butyl laurate, n-octyl caprilate, butyl stearate, and mixtures thereof.

10. A method for knitting, sewing, or braiding cords that each comprise two or more aramid yarns comprising knitting, sewing or braiding the cords of yarn to which has been added 0.1 wt. % to 3.0 wt. %, based on the cord weight, of a water-soluble or water-dispersible film forming binding agent, and thereafter has been further added an overlay finish consisting of an oil having an intrinsic viscosity less than 100 $mm^2/s$ at 25° C.

11. The method according to claim 10, wherein the oil is an ester oil.

12. The method according to claim 10, wherein the oil is selected from the group consisting of 2-ethyl hexyl stearate, 2-ethyl hexyl palmitate, n-butyl laurate, n-octyl caprilate, butyl stearate, and mixtures thereof.

* * * * *